United States Patent [19]

Palumbo

[11] 4,106,125

[45] Aug. 15, 1978

[54] CONVERTIBLE GARMENT

[76] Inventor: Angeline Palumbo, 3511 N. Narragansett, Chicago, Ill. 60634

[21] Appl. No.: 734,344

[22] Filed: Oct. 20, 1976

[51] Int. Cl.[2] ..... A41D 1/14

[52] U.S. Cl. ..... 2/213

[58] Field of Search ..... 2/213, 222, 72, 408, 2/211, 212, 215

[56] References Cited

U.S. PATENT DOCUMENTS

| | | | |
|---|---|---|---|
| 1,250,004 | 12/1917 | Philip | 2/213 |
| 1,629,561 | 5/1927 | Wellstatter | 2/72 |
| 1,807,908 | 6/1931 | Freed | 2/213 |

*Primary Examiner*—Doris L. Troutman

*Attorney, Agent, or Firm*—Gary, Juettner & Pyle

[57] ABSTRACT

A skirt or skirt portion of a dress is convertible into shorts or other pant-like garment by means of a concealed crotch panel that may be connected between the front and rear portion of the skirt between the legs of the wearer. Draw strings or other gathering means are provided adjacent the lower edge of the skirt in order to draw and gather the sides on either side of the crotch into fitting engagement with the legs of the wearer.

6 Claims, 6 Drawing Figures

CONVERTIBLE GARMENT

BACKGROUND OF THE INVENTION

This invention relates to wearing apparel and more particularly to feminine garments which are capable of easily being converted between a skirt or skirt portion of a dress and shorts or other pant-like garment, thus avoiding the necessity of changing from one garment to another.

Various proposals have been made regarding garments capable of being converted from skirt-like structures to pant-like structures as evidenced in U.S. Pat. No. 1,418,281, No. 1,470,849 and No. 1,629,561. Such prior art garments, however, have been unduly complicated in their construction or in the operations required to convert the garment from one form to another.

SUMMARY OF THE INVENTION

The present invention provides a convertible garment of unitary construction, requiring no special parts or attachments to be carried separately. The garment is normally in the form of a skirt or the skirt portion of a dress. A crotch panel is provided on one or on opposite sides of the skirt in a normally concealed position but may be secured between the front and rear panels of the skirt adjacent the lower edge. Draw strings or equivalent gathering means are provided in the lower margin of the skirt for the purpose of gathering the lower portion of skirt around the legs. The crotch panel or panels together with the gathering means allow the skirt to be easily and conveniently converted into pants or shorts without the necessity of removing the garment. When the garment is in the configuration of pants or shorts, it may be simply converted back into a skirt by restoring the crotch panel to its concealed position and releasing the gathering means.

THE DRAWING

DESCRIPTION OF THE PREFERRED EMBODIMENT

Figure 1:
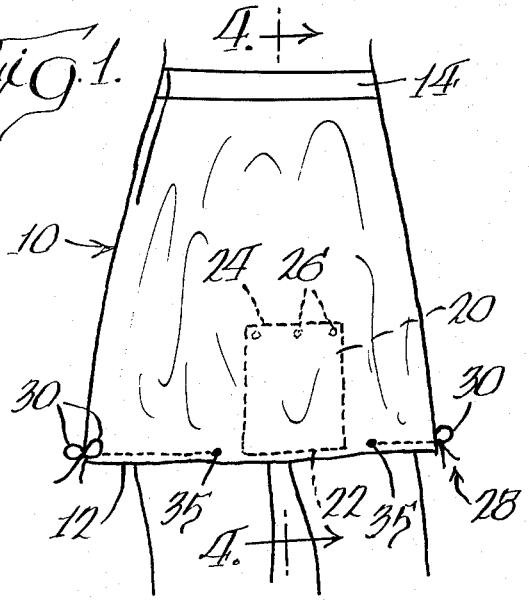
FIG. 1 is a perspective view of the convertible garment of the present invention in the configuration of a skirt.

As shown in FIG. 1 the basic structure of the apparel of the present invention is in the form of a free hanging garment made from any suitable fabric and commonly referred to as a skirt 10 adapted to be worn in the usual fashion and having a lower free margin or edge 12. It will be understood that the skirt referred to herein may take the form of a conventional skirt or may be a part of an upper body portion in the form of a dress, gym suit or body suit. In the embodiment shown, the skirt 10 is flared outwardly and is supported on the wearer by a waist band 14.

For the purpose of illustration, skirt 10 may be considered as comprising a front panel 16 and a rear panel 18 (FIG. 4), said panels being connected along their respective adjacent side margins to define a tubular section, which may be designed or fitted as desired to accommodate the size, style and other requirements of the prospective wearer. The garment may be constructed of any suitable flexible material such as textile fabrics. The skirt 10, as shown in FIG. 1, in fact resembles or is identical to a conventional skirt with the exceptions hereinafter described.

Figure 3:
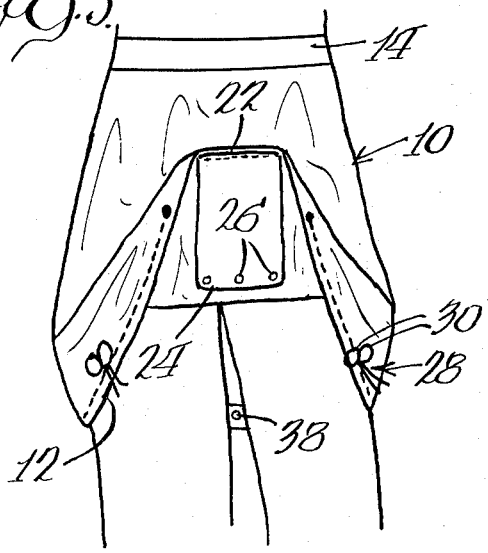
FIG. 3 is a perspective view of the garment shown in FIG. 1 with a portion thereof being raised to illustrate the concealed crotch panel.
Figure 4:
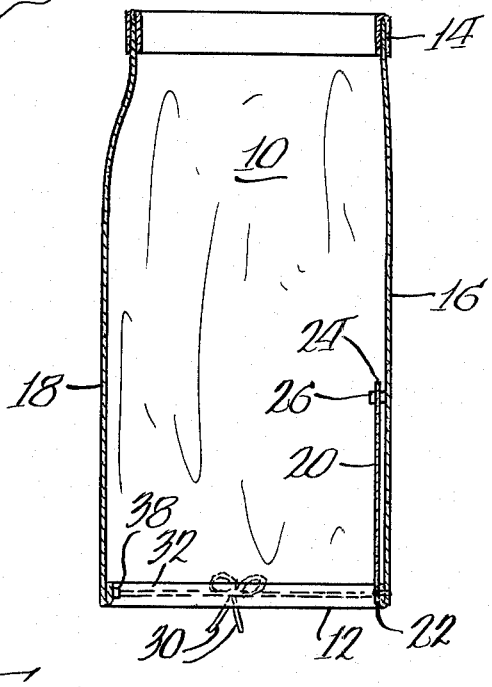
FIG. 4 is a sectional view taken along section line 4—4 of FIG. 1.

As best shown in FIGS. 1, 3 and 4, the garment comprises a crotch panel 20, which may be in a rectangular or other suitable form, another suitable form having an hour glass configuration having inwardly curved margins on the sides. One end edge of panel 22 is connected or secured at or adjacent the lower margin 12 of the skirt, such as by sewing, as shown. It may be seen that the crotch panel is secured centrally in the front or rear panel of the skirt, such that said panel is located in a position between the legs when the garment is being worn. Also, the secured edge 22 of the crotch panel 20 is preferably secured to the inside surface of the skirt panel, as shown in FIG. 3, so that the seam or other securement is not visible when the garment is being worn as a skirt, represented in FIG 1.

Portions of the crotch panel 20 remote from the secured edge 22, preferably the edge 24 opposite to the edge 22, are provided with releasable attachment means for frangibly or releasably attaching such portions to the same inside surface to which the secured edge 22 is made. As shown, preferably the free edge 24 opposite the secured edge 22 of the crotch panel 20 is provided along its inside surface with one or a plurality of releasable attachment means 26 that releasably attach to the inside panel of the skirt 16 or 18 in a manner such that the crotch panel lays flat or substantially flat on the inside surface of the skirt panel when said edge 24 is secured in attached position. As shown, the crotch panel 20 is attached to or is otherwise situated on an inside surface of the skirt in a manner that conceals said panel from view when the garment is worn as a skirt.

The attachment means 26 may take one of several available forms but normally will comprise parts secured to the free edge 24 that attach to corresponding parts on the inside panel of the skirt. Suitable attachment means, for example, will comprise snaps, hooks, hook and pile fabric, or the like.

Figure 2:
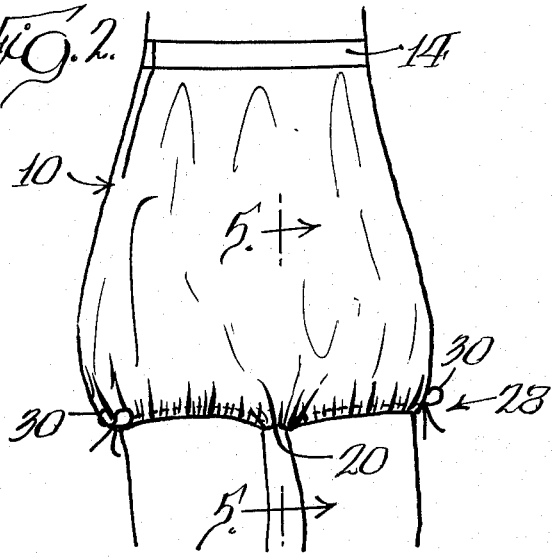
FIG. 2 is a perspective view of the garment shown in FIG. 1 after the garment has been converted into the form of shorts.

As shown in each of the figures, gathering means 28 are provided at or adjacent the bottom margin 12 of the skirt 10, the purpose of which is to gather the loose folds or free hanging fabric of the skirt around the legs of the wearer when the skirt is converted to a pant-like garment (FIG. 2). As shown, such gathering means 28 preferably comprise flexible tethers such as draw strings or tapes 30 slidably enclosed in a lower hem 32 of the skirt. As shown, four elastic or non-elastic strings or tapes 30 may be employed. Each string or tape 30 is secured at one end 35 (FIG. 1) near the center of each panel 16 or 18 of the skirt and leads to the outside edge of the panel through a side opening in the hem 32. In such a manner, the string or tape 30 from one side of the front panel exists through the same opening as the rear panel on the same side of the skirt. The pairs of strings or tapes 30 on opposite sides of the skirt may be tied or otherwise adjustably secured together at different lengths depending on whether the garment is worn as a skirt or shorts. Obviously, multiple rows of draw strings could be provided, and other forms of gathering means, such as releasable elastic gathering means, could be employed to accomplish the same general purpose.

Referring to FIGS. 1, 2 and 3, it may be seen that the draw strings 30 are preferably each attached at the inner end to a location 35 outside the area or circumference of the skirt that is or will be occupied by the crotch panel 20. This feature confines the gathering of the skirt to the loosely hanging areas of the skirt and tends to pull the crotch panel around the legs of the wearer when the gathering means are tightened.

Figure 5:
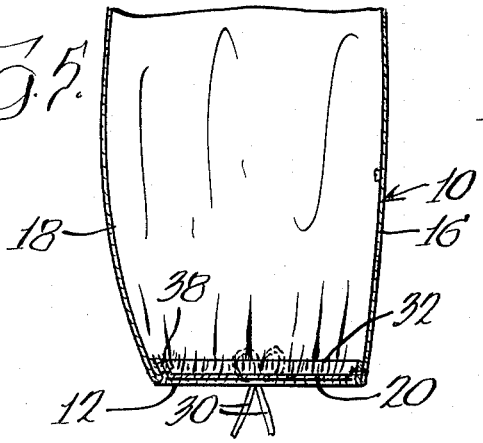
FIG. 5 is a partial sectional view taken along section line 5—5 of FIG. 2.

The steps required to convert the garment from the skirt configuration shown in FIG. 1 to the pant-like configuration shown in FIG. 2 will now be apparent. First, the free edge 24 of the crotch panel 20 is detached from its releasable fastening and is drawn underneath the crotch of the wearer, conformably therewith. The free edge 24 is then attached to similar fasteners 38 located in or adjacent the lower central portion of the skirt opposite the secured edge, substantially as shown in FIGS. 2, 4 and 5.

The gathering means 28 around each leg is then tightened in order to draw the loosely hanging fabric from the form of a skirt (FIG. 1) into the form of a pant-like garment (FIG.2) in which the lower portion of the skirt is gathered around the respective legs, and together with the crotch panel 20, define leg portions adjacent the crotch that are coextensive with the gathered fabric around the torso of the wearer. Of course, the garment may be easily restored to the FIG. 1 configuration by releasing the gathering means and restoring the crotch panel to its orginal concealed position.

Figure 6:
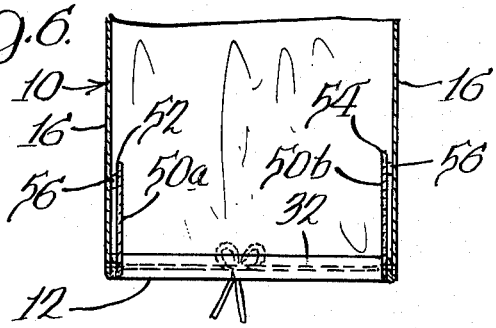
FIG. 6 is a fragmentary sectional view similar to FIG. 4 illustrating a futher embodiment of the invention.

In another embodiment of the invention illustrated in FIG. 6, the crotch panel 50 may be divided into two parts 50*a* and 50*b*. One edge of each part may be secured centrally on opposite sides of the skirt of the hemline. The free ends 52 and 54 bear fasteners 56 which may either be secured together to complete the crotch in the FIG. 2 configuration or may be releasably secured to like fasteners on the inside of the respective skirt panels in concealed position, corresponding to the FIG. 1 configuration.

From the foregoing, it may be seen that the garment of the present invention may be easily converted, either while being worn or otherwise between the configurations of FIGS. 1 and 2, thus rendering the garment highly versatile and adaptable to a variety of requirements.

I claim:

1. A garment made of material and convertible between a skirt-like garment comprising a skirt having a lower margin and a front and rear side, a central crotch means secured at one end to said skirt near the lower margin thereof, the other end of said crotch means being free and movable from a concealed position inside said skirt to a connecting position extending between said front and rear sides, means on an interior surface of said skirt spaced from the secured end of said crotch means for releasably securing the free end of said crotch means in said concealed position, and means on said skirt for releasably gathering the material of said skirt and drawing said crotch means around the legs of the wearer near the bottom margin of said skirt, said gathered material and crotch means together defining leg portions of the garment.

2. The garment of claim 1 wherein said crotch means comprises a panel, and releasable attachment means at the lower margin of the skirt opposite the secured end of said panel for attaching said free end interior surface of said skirt in a concealed position to the other side of the skirt.

3. The garment of claim 1 wherein said crotch means comprises a pair of opposite panels each secured at a first end to respective front and rear sides of said skirt, and means for releasably attaching the other ends opposite said first end together.

4. The garment of claim 1 wherein said means for gathering the material comprises a flexible tether adjacent the lower margin of the skirt.

5. The garment of claim 4 whereing said skirt comprises a hem at the lower margin thereof, and said flexible tether is positioned in said hem.

6. The garment of claim 5 wherein pairs of said tethers are provided at each side of said skirt on both sides of said crotch means, each tether being secured at one at the central lower portion of said skirt and having a free end extending externally from said hem at the sides of said skirt.

* * * * *